US005836832A

United States Patent [19]

Boehm et al.

[11] Patent Number: 5,836,832

[45] Date of Patent: Nov. 17, 1998

[54] GOLF BALL

[75] Inventors: Herbert C. Boehm, Norwell, Mass.; William E. Morgan, Barrington, R.I.; Steven Aoyama, Marion, Mass.; Dean A. Snell, Acushnet, Mass.; Steven M. Gosetti, Providence, R.I.; Samuel A. Pasqua, Jr., Bristol, R.I.

[73] Assignee: Acushnet Company, Fairhaven, Mass.

[21] Appl. No.: 705,025

[22] Filed: Aug. 29, 1996

Related U.S. Application Data

[60] Provisional application No. 60/003,145 Sep. 1, 1995.

[51] Int. Cl.[6] ..... A63B 37/06; A63B 37/08; A63B 37/12; A63B 37/14

[52] U.S. Cl. ..... 473/354; 473/365; 473/384; 273/DIG. 20

[58] Field of Search ..... 273/DIG. 20; 473/377, 473/383, 384, 378, 351, 356, 357, 358, 361, 362, 363, 364, 365, 354

[56] References Cited

U.S. PATENT DOCUMENTS

| | | | |
|---|---|---|---|
| 2,364,955 | 12/1944 | Diddel | 473/377 |
| 3,819,190 | 6/1974 | Nepela et al. | 473/383 |
| 4,085,937 | 4/1978 | Schenk | 273/218 |
| 4,258,921 | 3/1981 | Worst | 473/268 |
| 4,284,276 | 8/1981 | Worst | 473/383 |
| 4,729,861 | 3/1988 | Lynch et al. | 264/219 |
| 4,836,552 | 6/1989 | Puckett et al. | 273/DIG. 20 |
| 4,968,038 | 11/1990 | Yamada | 273/232 |
| 5,000,459 | 3/1991 | Isaac | 273/235 |
| 5,273,287 | 12/1993 | Molitor et al. | 273/232 |
| 5,421,580 | 6/1995 | Sugimoto et al. | 473/383 |
| 5,467,994 | 11/1995 | Moriyama et al. | 473/384 |
| 5,511,791 | 4/1996 | Ebisuno et al. | 473/354 |
| 5,609,532 | 3/1997 | Chikaraishi | 473/384 |

OTHER PUBLICATIONS

G. Magnus, *Poggendorfs Annual on Physics and Chemistry*, vol. 88 (1853). (No translation provided.).

C. Stine, *Golf Week*, "Ball Made for Slow Swingers Taking Fast Track to Market", pp. 50–51 (Apr. 16, 1994).

P. M. Fuchs, "Physical Model, Theoretical Aspects and Applications of the Flight of a Ball in the Atmosphere. Part III," *Mathematical Methods in the Applied Sciences*, vol. 18, pp. 202–223 (1995).

S. Donahue, "Hey Buddy, Got A Lite?", *Golf World,* Feb. 17, 1995, pp. 64, 66.

T. Ferrell, "This Ball's For You, How to Match a Golf Ball Design to Your Game", *Golf Tips,* Jun. 1995, pp. 69–70, 73, 75.

*Primary Examiner*—George J. Marlo
*Attorney, Agent, or Firm*—Pennie & Edmonds LLP

[57] ABSTRACT

The present invention is directed to golf balls which have a lift to weight ratio greater than 1 when the ball is hit at a speed of 150 ft/sec and a spin rate of 3,000 rpm to enhance the lofting time of the ball and thereby provide the golfer with a slow swing speed increased distance and improved trajectory. The golf ball has a core and a cover. The cover has dimples ranging in number from 100 to 1,000 and having a total volume of less than 1.5% of the ball volume on its exterior surface. The dimples have diameters between 0.04 and 0.3 inch and depths between $^{2}/_{1,000}$ and $^{20}/_{1,000}$ of an inch. The golf ball weight ranges from 1.35 ounces (38.3 grams) 1.55 ounces (43.97 grams). The cover material has a flexural modulus of less than 65,000 p.s.i.

15 Claims, 2 Drawing Sheets

GOLF BALL

CROSS-REFERENCE TO RELATED APPLICATIONS

This application claims the benefit of U.S. Provisional Application No. 60/003,145, filed Sept. 1, 1995.

FIELD OF THE INVENTION

This invention relates to a golf balls having improved lofting characteristics through the use of reduced weight components and overall ball construction which favors increased lift.

BACKGROUND OF THE INVENTION

With the increase in the number of materials which can be used in golf balls, there has been a trend towards specialization resulting in golf balls having different performance characteristics which are designed for the skill level of the golfer, the type of golf course, and even atmospheric conditions.

Golfers encompass a wide range of ages, physiques, skill levels, and attitudes. They swing widely varying clubs with widely varying golf swings. Therefore, it is not surprising that when they strike a golf ball, they achieve a wide range of ball velocities, launch angles, and spin rates. An average swing speed player will generally, when using a driving club, produce a ball velocity of about 200 ft/sec. When using a driving club, golfers who swing the club relatively slowly tend to produce ball velocities of lower than the average of about 200 ft/sec. They also tend to produce spin rates which are somewhat lower than average.

The slow swinging golfer has traditionally been at a disadvantage when playing with faster swinging golfers as a result of the difference in force with which a slow swinging club and a fast swinging club hit a golf ball. The velocity imparted to a golf ball when hit by a clubhead is directly proportional to the product of the velocity at which the club head hits the ball and the mass of the clubhead. Thus, all else being equal, a faster swinging club will hit the ball with more force than a slower swinging club. A ball hit with a faster swinging club will attain greater velocity than a ball hit with a slower swinging club and, thereby, will fly a further distance.

Similarly, the fast swinging golfer will impart greater backspin to the ball, which, along with greater velocity, creates greater aerodynamic lift. Accordingly, a slow swinging golfer, who cannot impart the degree of spin and velocity necessary to impart substantial lift to the ball, will achieve a different trajectory than a fast swing golfer. A fast spinning, high velocity ball with substantial lift starts out with a trajectory similar to simple projectile motion but will curve up, achieve a higher height and have a prolonged arc of flight time before dropping to the ground. A low spinning ball without substantial lift will more closely follow the simple parabolic curve of projectile motion.

Various attempts have been made in the past to manufacture balls which help to resolve the problems slower swinging golfers have. In general these balls, and in particular, the Kasco Dual Core family and the Bridgestone Precept EV family, have employed materials and/or construction which has been considered to provide greater velocity at slow swing speeds than conventional balls on the market. Recently, other balls such as the Cayman Golf Company's SPECTRA and the Ram Laser Light have attempted to achieve a similar end by having a ball weight lower than the USGA maximum weight, i.e., 1.62 ounces. The apparent theory behind these golf balls is that lower weight balls will have a higher ratio of clubhead mass to ball mass thereby increasing the initial velocity of the ball. Such balls can still pass the USGA velocity test because, in that test, an "infinite" mass (i.e. a clubhead mass which is far greater than the mass of the ball being tested) is utilized to hit the ball. Because of this, the ratio of clubhead mass to ball mass is always essentially the same. Despite these numerous efforts, the trajectory problems encountered by the slower swinging golfer remain unresolved.

One problem associated with using a smaller mass golf ball is that it will be more affected by aerodynamic drag than a heavier ball, which will tend to reduce flight distance. Accordingly, there has been and remains a need in the golf ball art for an improved golf ball designed for slow swing speed golfers offering improved flight distance.

SUMMARY OF THE INVENTION

The present invention is directed to golf balls providing enhanced lofting characteristics which include a core and a cover. The cover has dimples on its exterior surface. The golf ball has a weight of from about 1.35 ounces to about 1.55 ounces and provides a lift-to-weight ratio of greater than 1 during at least part of the ball's flight.

In a preferred embodiment of the present invention, the dimples have a volume of between about 0.8% and 2% of the total volume of the golf ball. More preferably, the golf ball dimples include a volume ranging from about 1% to about 1.7% of the total volume of the golf ball.

The cover material has a flexural modulus of less than about 65,000 psi. The cover material may be selected from the group consisting of urethanes, ionomers, and balata.

The core may include a wound layer around a center portion which may be a solid or a liquid center. The core may also include at least two distinct layers.

DETAILED DESCRIPTION OF THE INVENTION

Figure 1:
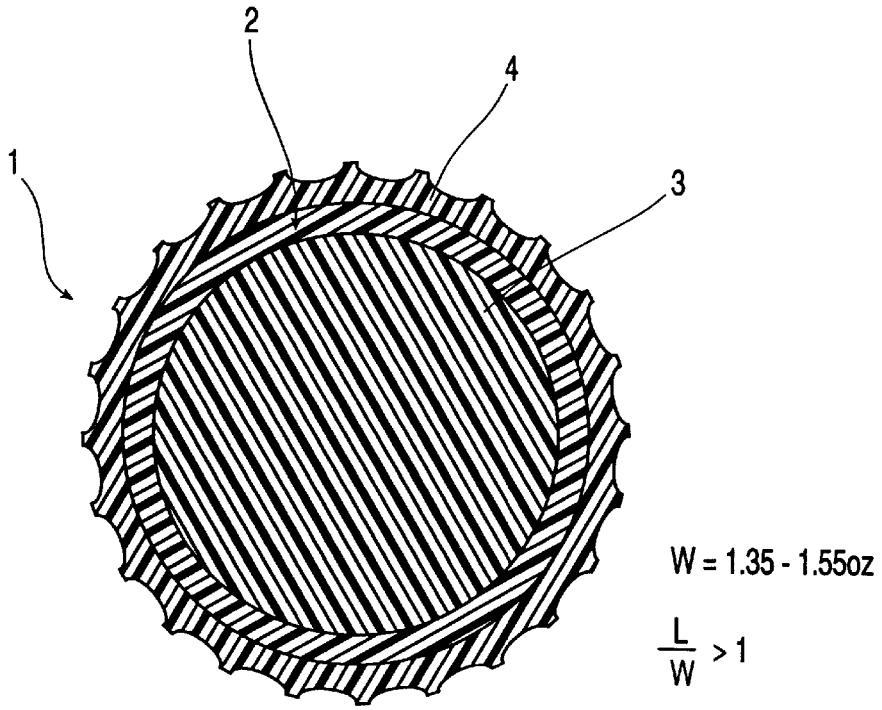
FIG. 1 is a cross section of a golf ball (1) depicting a core (2) with a center (3) and a cover (4), according to the invention.
Figure 2:
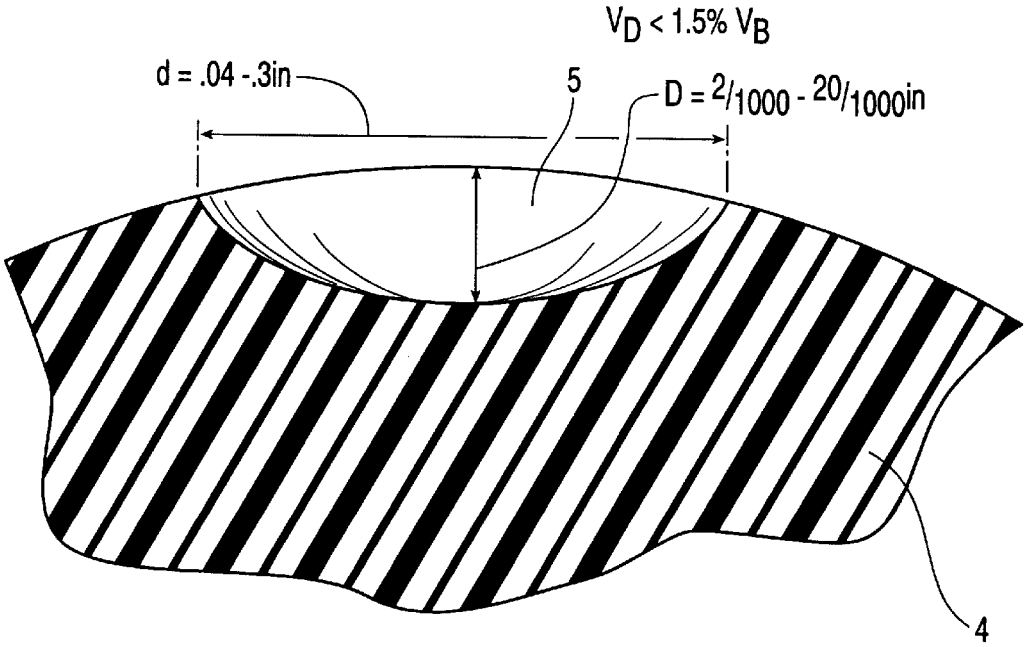
FIG. 2 is a blown up view of a cover (4) with a dimple (5) of a depth (D) measured from the phantom ball surface to the deepest part of the dimple and a diameter (d), according to the present invention.
Figure 3:
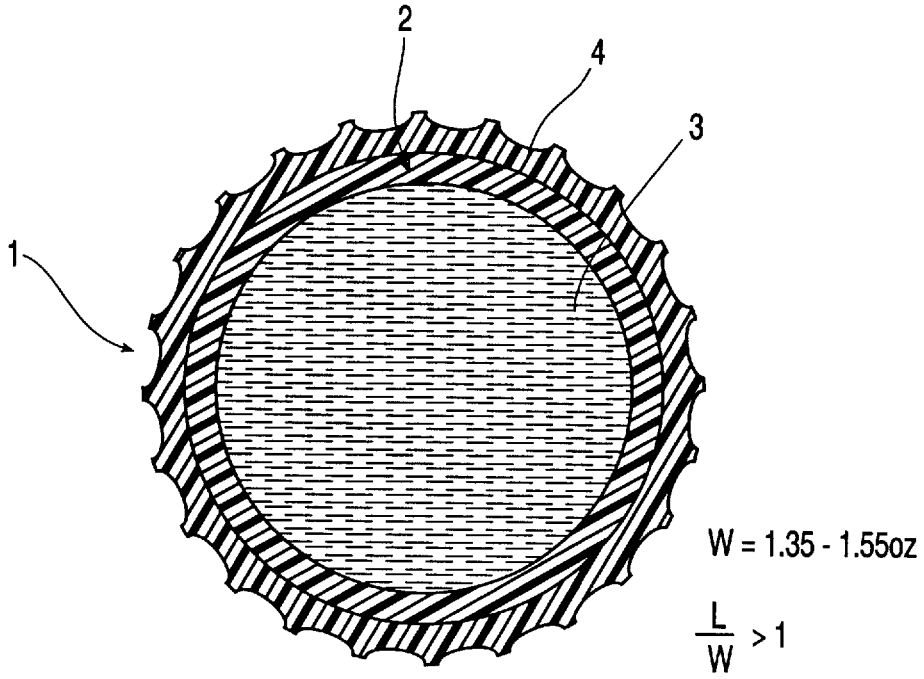
FIG. 3 is a cross section of a golf ball (1) depicting a core (2) with a liquid center (3) and a cover (4), according to the invention.

The present invention is directed to golf balls which combine numerous different construction elements that increase the lofting ability of a golf ball.

For purposes of the present invention, the lofting time of a golf ball is defined as the period from the time the ball is hit to the time the ball hits the ground.

A golf ball in flight experiences two forces —aerodynamic (drag and lift) and gravity. Generally, drag and lift (D and L) can be expressed as follows:

$$D = {}^{1}/_{2}\,\rho C_D u^2 A$$

$$L = {}^{1}/_{2}\,\rho C_L u^2 A$$

where $C_D$ and $C_L$ are drag and lift coefficients, ρ is air density, A is the cross-sectional area of the ball, and u is the velocity of the ball through the air. The lift-to-weight ratio is defined as L/W, where W is weight of the golf ball.

When struck by a low swing speed golfer using a driver type of club, a golf ball of the present invention provides a lift-to-weight ratio of greater than 1 during at least part of the resulting flight of the ball. To accomplish this, the golf ball has increased aerodynamic lift force, which is the result of increased spin and/or increased velocity and/or the use of high lift dimples, and decreased weight.

For the purposes of this invention, a low swing speed golfer is considered to be one who achieves a ball velocity of less than 200 ft/sec. As an example for calculation purposes, a typical low swing speed golfer is one who, when hitting a Pinnacle Gold golf ball using a driver type club, achieves a ball velocity of about 150 ft/sec, a launch angle from horizontal of about 14 degrees, and a spin rate of about 3,000 rpm. The 1996 Pinnacle Gold is a conventional solid construction distance ball manufactured by the Acushnet Company having a nominal size of 1.68 inches, a nominal weight of 1.62 ounces, a cover flexural modulus of about 65,000 psi, and a PGA compression rating of about 105.

A ball's lift coefficient is influenced quite strongly by spin. The greater the spin rate of the ball the more lift experienced. It is well known that the dimple pattern also markedly affects the lift, and the way it depends on spin. That is, the lofting ability of a golf ball launched at a particular angle, with a given speed and spin, is affected by the lift characteristics bestowed upon it by its particular dimple pattern. Any factors which can increase the lift coefficient may be used to maximize the lofting time of the inventive balls of the present invention.

Golf balls according to the present invention have weights that are less than the USGA maximum weight for golf balls. The weight reduction for golf balls according to the present invention may come from either the core, the cover or a combination of both. It is more advantageous to have the weight reduction of balls according to the present invention result from less mass in the cover so that the moment of inertia of the ball can be reduced to increase spin.

Fillers are commonly added to the core in order to bring the mass of the ball up to a mass that is close to the maximum specified by the USGA. It is preferred that a reduction in core mass be accomplished by reducing the amount of filler that is added to the core. Also any filler can be added to the core in a manner such that the density of the core varies with distance from the center of the golf ball. By, for example, having the density of the core become smaller as the distance from the center increases it is possible to decrease the moment of inertia of the golf ball to thereby increase the spin of the ball when hit. Such increased spin is translated into increased lofting ability for the golf ball.

The weight of golf balls according to the present invention ranges from about 1.35 ounces to 1.55 ounces. More particularly, weights nearer the higher end of this range are preferable for golfers whose swing speeds are only moderately slow, while weights nearer the lower end of this range are preferable for golfers having very slow swing speeds.

Golf balls according to the present invention also employ "high lift" dimples. For dimples of conventional spherical shape, high lift dimples are those which are smaller and/or shallower than dimples traditionally used to cover the majority of the surface area of the ball, i.e., they have reduced depth and/or diameter than regular dimples.

The dimples employed for the subject golf balls have diameters d between about 0.04 inches and about 0.30 inches. More preferably the dimples will have a diameter between about 0.06 and about 0.25 inches. Most preferably dimples according to the present invention will have diameters of from about 0.08 inches to about 0.17 inches.

The depth of the dimples employed in the present golf balls will tend to be shallower than usual, but can be any depth which will result in lift properties conducive to producing the desired enhanced loft trajectory. In particular, the dimples according to the present invention will have a depth D of from about $^{2}/_{1000}$ of an inch to about $^{20}/_{1000}$ of an inch when measured from the phantom ball surface to the deepest part of the dimple. More particularly, dimples according to the present invention may have depths of from about $^{5}/_{1000}$ of an inch to about $^{17}/_{1000}$ of an inch. Most preferred are dimples having a depth of from about $^{7}/_{1000}$ of an inch to about $^{15}/_{1000}$ of an inch. This presumes that the dimples have a conventional spherical shape. Other shapes may require different depths to provide the desired lift properties.

The number of dimples on the surface of golf balls according to the present invention may also vary widely. The number of conventional spherical dimples can be from about 100 to about 1000 or, more preferably, from about 300 to about 500. Most preferably, there are from about 332 to about 440 dimples on the surface of golf balls according to the present invention. Other dimple shapes may require different numbers.

Since the depth and diameter of the dimples can be used to calculate the total dimple volume $V_D$ for a particular golf ball, the high lift dimples of the present invention can also be described by the total dimple volume they take up on a particular golf ball surface. This allows for the presence of a variety of different sized dimples.

If the dimples are spherical in shape, it is preferred that the total dimple volume of dimples according to the present invention be from about 0.8% to about 2% of the total volume $V_B$ of the golf ball, or more preferably from about 1% to about 1.7%. In the most preferred mode of the present invention the total dimple volume will be from about 1.2% to about 1.5%. As stated above the total dimple volume can be varied and is but one element of the claimed invention which can be adjusted depending on the other elements which effect the lift effect and thus the lofting time and distance of the claimed golf balls. Examples of specific dimple configurations that can be used in the golf balls of the present invention include those disclosed in U.S. Pat. Nos. 4,560,168, 5,158,300, 4,960,281, and 5,415,410. Moreover U.S. Pat. No. 4,729,861 provides a detailed discussion of dimple theory and sets forth numerous different dimples which can be used in the present invention.

The construction of the golf ball is also a factor in the spin and therefore lift of golf balls according to the present invention. In general wound golf balls spin more than solid core two or three piece golf balls. Accordingly, while the various elements of the present invention can be used in combination with any golf ball construction, it is preferred that wound cores be used.

Further, all else being equal, solid centers can often be made to spin faster than liquid centers. Therefore it is preferred to use solid centers in golf balls according to the present invention.

The hardness of the core of a golf ball can also effect the spin of a golf ball. In general, the harder the core, the greater the spin. Accordingly, those additives, well known to the skilled artisan, that will increase the compression of the core are also within the scope of the claimed invention.

Cover material can have a dramatic effect on the spin imparted to a golf ball. The softer the cover material the greater the spin. Softer cover materials include balata and very low modulus ionomers. However, various blends of cover materials can be mixed in order to provide optimum spin depending on the other properties that the inventive golf balls will have. It is preferred to use softer cover materials which have a flexural modulus of less than about 65,000 psi as softer cover materials have been found to increase the spin of golf balls. Cover materials for use in the present invention include those disclosed in U.S. Pat. Nos. : 5,298,571; 5,120,791; 5,068,151; 5,000,549; 3,819,768; 4,264,075; 4,526,375; 4,911,451; 5,197,740; and 3,264,272.

Golf balls incorporating two or more elements of the present invention are intended to maximize flight time, and loft due to lift, for the slower swinging golfer. Flight times of golf balls for this type of golfer according to the present invention may vary depending on what type of club is used, what the weight of the ball is, etc. and can vary considerably over the range of from about 1 second to about 7 seconds, although most will range from 2 second to about 6 seconds or more particularly from about 3 seconds to about 5 seconds.

Further, a golf ball according to the present invention will be capable of achieving a maximum height when in flight that is greater than the height capable using the newtonian standards for projectile flight when hit with any club head speed, including those typical of low swing speed golfers.

All aforementioned patents mentioned herein are specifically incorporated in their entirety.

It should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. A golf ball having a volume and providing enhanced lofting characteristics for a low swing speed player which comprises:

a core; and a cover having an exterior surface with a plurality of dimples formed thereon, wherein said dimples have a dimple volume of less than 1.5% of the total volume of the golf ball and wherein said golf ball has a weight from 1.35 ounces to 1.55 ounces and a lift-to-weight ratio greater than 1 during at least part of the ball's flight when hit at a speed of 150 ft/sec and a spin rate of 3000 rpm.

2. The golf ball according to claim 1, wherein the cover material has a flexural modulus of less than 65,000 psi.

3. The golf ball according to claim 1, wherein the dimple volume ranges from 1.2% to 1.5% of the total volume of the golf ball.

4. The golf ball according to claim 1, wherein the ball has a weight of from 1.35 ounces to 1.45 ounces.

5. The golf ball according to claim 1, wherein the core includes a center portion and a wound layer around the center portion.

6. The golf ball according to claim 5, wherein the center portion is solid.

7. The golf ball according to claim 5, wherein the center portion is liquid.

8. The golf ball according to claim 1, wherein the core includes at least two distinct layers.

9. The golf ball according to claim 1, wherein the cover material is selected from the group consisting of urethanes, ionomers or balata.

10. The golf ball according to claim 1, wherein the, dimples have diameters between 0.04 inches and 0.3 inches.

11. The golf ball according to claim 1, wherein the dimples have a depth of from $^{2}/_{1000}$ of an inch to $^{20}/_{1000}$ of an inch.

12. The golf ball according to claim 1, wherein the number of dimples ranges from 100 to 1000.

13. A golf ball having a volume and providing enhanced lofting characteristics for a low swing speed player which comprises:

a core comprised of a center portion and a wound layer surrounding the center portion; and a cover having an exterior surface with a plurality of dimples formed thereon, wherein said dimples have a dimple volume of less than 1.5% of the total volume of the golf ball and wherein said golf ball has a weight from 1.35 ounces to 1.55 ounces.

14. The golf ball of claim 13, wherein the center portion is solid.

15. The golf ball of claim 13, wherein said golf ball has a lift-to-weight ratio of greater than 1 during at least part of the ball's flight when hit at a speed of 150 ft/sec and a spin rate of 3000 rpm.

* * * * *